US008487537B2

(12) United States Patent
Sloan et al.

(10) Patent No.: US 8,487,537 B2
(45) Date of Patent: Jul. 16, 2013

(54) LED DRIVE CIRCUIT

(75) Inventors: Thomas C. Sloan, Santa Barbara, CA (US); Bruce Quaal, Ventura, CA (US)

(73) Assignee: The Sloan Company, Inc, Ventura, CA (US)

( * ) Notice: Subject to any disclaimer, the term of this patent is extended or adjusted under 35 U.S.C. 154(b) by 1119 days.

(21) Appl. No.: 12/321,422

(22) Filed: Jan. 20, 2009

(65) Prior Publication Data

US 2010/0181919 A1 Jul. 22, 2010

(51) Int. Cl.
*H05B 37/00* (2006.01)

(52) U.S. Cl.
USPC ..... 315/119; 315/121; 315/312

(58) Field of Classification Search
USPC ..... 315/185 R, 185 S, 193, 200 R, 201, 315/205, 312, 119, 121; 362/227, 235, 251, 362/252, 800, 806
See application file for complete search history.

(56) References Cited

U.S. PATENT DOCUMENTS 3,755,663 A 8/1973 George
5,563,472 A 10/1996 Cassidy
6,157,139 A * 12/2000 Gibboney, Jr. ..... 315/185 S
6,158,882 A 12/2000 Bischoff, Jr.
7,029,145 B2 * 4/2006 Frederick ..... 362/234
7,852,011 B2 * 12/2010 Peng ..... 315/185 R
7,928,667 B2 * 4/2011 Peng ..... 315/294
2006/0133076 A1 6/2006 Sloan
2006/0197474 A1 9/2006 Olsen
2007/0132602 A1 6/2007 Ito et al.

OTHER PUBLICATIONS

International Search Report and Written Opinion from counterpart application PCT/US2010/000141 mailed Jul. 30, 2010.
International Rectifier IRLML2803 Data Sheet, Date: Apr. 10, 2007, pp. 1-9.
Infineon Technologies, BCR402U, Data Sheet, Feb. 3, 2004, pp. 1-4.
Office Action from German Patent Application No. 11 2010 000 827.2, dated Apr. 18, 2013.

* cited by examiner

*Primary Examiner* — Jimmy Vu
(74) *Attorney, Agent, or Firm* — Koppel, Patrick, Heybl & Philpott

(57) ABSTRACT

A retained and a removable circuit connect together to form a closed circuit. A switching mechanism is connected between the retained and removable circuits and to a circuit break load. Upon disconnection of the circuit break load and/or the removable circuit, the switching mechanism automatically switches from an open circuit to a closed circuit to form a closed circuit with the retained circuit.

34 Claims, 8 Drawing Sheets

LED DRIVE CIRCUIT

BACKGROUND OF THE INVENTION

1. Field of the Invention

The present invention is related to drive circuits for semiconductor devices, and in particular drive circuits for interconnected light emitting diodes (LEDs).

2. Description of the Related Art

LEDs are semiconductor photon sources that can serve as highly efficient electronic-to-photonic transducers. They are typically forward-biased p-n junctions fabricated from a semiconductor material that emits light via injection electroluminescence. Their small size, high efficiency, high reliability, and compatibility with electronic systems make them very useful for a multitude of applications. Recent advancements have yielded high-power LEDs in a range of colors. This new generation of LEDs is useful in applications requiring a higher intensity light output such as high-power flash lights, airplane lighting systems, fiber-optic communication systems, and optical data storage systems.

High-flux lighting solutions are required by various modern applications such as street lighting, airport/airplane lighting systems, pool lighting systems, and many others. In order to achieve additional luminous output, multiple LEDs are often arranged in various configurations or arrays. These arrays may take nearly any shape and usually include several individual LEDs.

In order to further increase luminous output, several LED arrays may be grouped together on a surface. Providing the necessary electrical connections to power the LED arrays can be challenging. The layout of the individual LEDs on the array surface determines where the input and output connections must be located on the surface and how the LED arrays must be arranged so that they can be connected together. Many of the connections and underlying circuitry for powering and controlling LED output are provided for by drive circuits.

Typically, LEDs are grouped together and sold in sets, such as a roll or a strip. These LEDs must typically be cut in the field by an installer to a desired length or configuration for a given application, such as lighting elements for a sign. One problem in that arises is cutting the undesirable LEDs from the set also cuts the underlying drive circuitry. This causes the drive circuitry to form an open circuit, thereby rendering the LEDs retained for installation inoperable without additional rewiring. Rewiring the drive circuitry takes time and additional tools, and can be cumbersome to perform in the field.

SUMMARY OF THE INVENTION

One embodiment of the present invention provides a drive circuit system having a retained circuit branch and a removable circuit branch connected together. The removable circuit branch also connects to an electrical ground, so that the removable and retained circuit branch form a closed drive circuit. A switching element is also connected between the retained and removable circuit branch and to an electrical ground, as well as to a circuit break load. The switching mechanism automatically forms a closed circuit upon disconnection of the removable circuit and the circuit break load.

Another embodiment provides a drive circuit system having a retained circuit branch and a removable circuit branch connected together. The removable circuit branch also connects to an electrical ground, so that the removable and retained circuit branch form a closed drive circuit. A switching element is also connected between the retained and removable circuit branch and to an electrical ground as well as to a circuit break load. The switching mechanism automatically forms a closed circuit upon a disconnection of the circuit break load.

Another embodiment provides a method for closing a retained circuit. A switching element is connected between a retained circuit branch and a removable circuit branch and to a circuit break load. The circuit break load is disconnected from the switching element and the removable circuit branch from the retained circuit branch, thereby causing the switching element to automatically switch from an open circuit to a closed circuit.

DETAILED DESCRIPTION OF THE INVENTION

Figure 1:
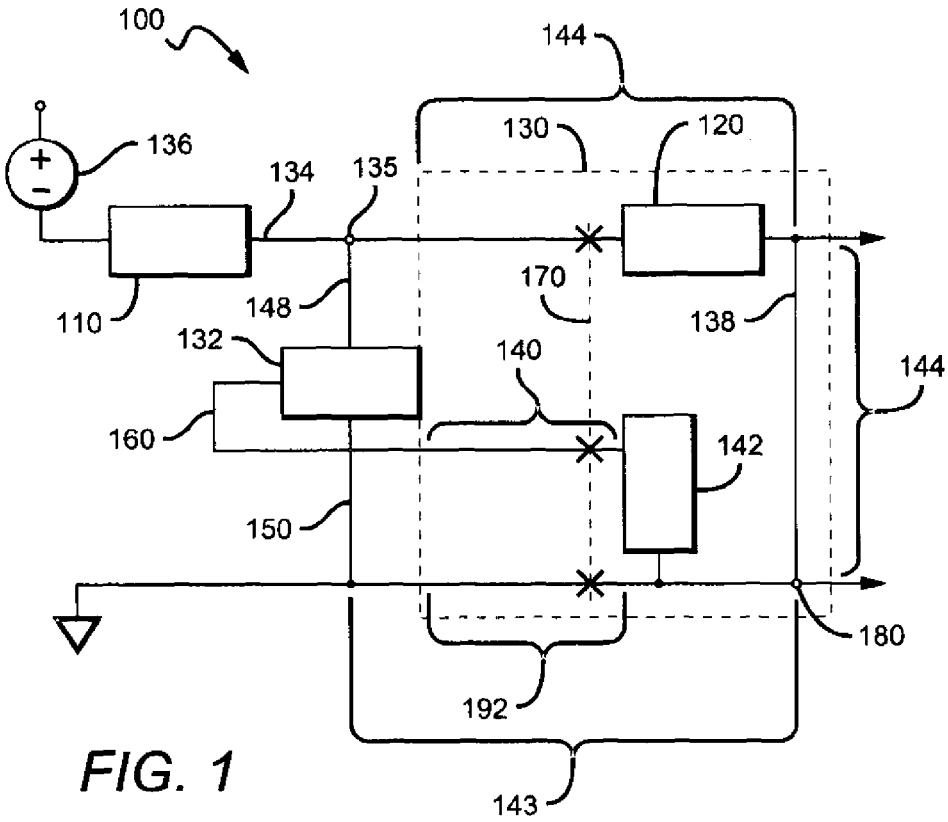
FIG. 1 is a schematic of an embodiment of the drive circuit having a retained circuit branch, a switching element and a removable circuit branch.

FIG. 1 depicts one embodiment of an LED drive circuit 100. The physical arrangement and number of elements can vary; their illustration in FIG. 1 shows only one potential arrangement/combination. The term "ground" referred to herein also refers to "the return" or "return path".

The LED drive circuit 100 preferably comprises two or more circuit branches that are connected together by a circuit branch connector 134, which is typically a wire or other arrangement that provides electrical conduction between the branches. FIG. 1 shows the LED drive circuit 100 having a retained circuit branch 110 connected to a circuit branch power source 136 and to a removable circuit branch 120, which also connects to ground through a circuit branch ground connector 138. The two circuit branches preferably connect to each other via the circuit branch connector 134 at a connection 135. Two circuit branches are shown for illustrative purposes only; additional circuit branches may also be present for this and all other embodiments.

In the preferred embodiment, a switching element 132 is arranged between each circuit branch, and is connected to a circuit break load 142 by a switching load connector 160. A removable circuit 130 comprises the removable circuit branch 120 and the circuit break load 142. When the removable circuit 130 is present—i.e. the removable circuit branch 120 is connected to the retained circuit branch 110 and the circuit break load 142 is connected to the switching element 132—the switching element 132 operates in open circuit mode and does not conduct electricity. This configuration and mode causes current from the retained circuit branch 110 to conduct to the removable circuit branch 120. Current from the circuit branch power source 136 thus bypasses a switching element 132 and conducts through the second branch circuit 120 and the circuit branch ground connector 138 to ground point 180. In this manner, the retained and removable circuit branches form a closed circuit.

When the removable circuit 130 is electrically or physically disconnected from the rest of the drive circuit—i.e. the removable circuit branch 120 is no longer connected to the retained circuit branch 110 and the circuit break load 142 is not connected to the switching element 132—the switching element 132 is designed to automatically form a closed circuit with respect to the retained circuit branch 110, allowing it to conduct electricity and continue operating despite the removal of the removable circuit 130. The switching element 132 typically forms the closed circuit with the retained circuit branch 110 automatically by switching from an open circuit mode to a closed circuit mode to conduct electricity. Current from the retained circuit branch 110 is automatically directed through the switching element 132 to ground, despite removal of the removable circuit 130. One benefit of this type of automatic circuit selection system is to allow the removal of circuits quickly and efficiently in the field, allowing the remaining circuit portions to continue operating without the need for additional rewiring to compensate for the removed circuit(s). In applications where the LED drive circuit is used in a strip of LEDs, for example, a user can cut, break or disconnect the strip of LEDs to a desired length and immediately use the undiscarded portion, thereby making the installation of the LED strip more efficient.

In one embodiment, the removable circuit 130 is disconnected by making a single physical cut, break or disconnection at a prescribed region, which cuts at least two, usually three, wires inside the LED drive circuit. One of the internal wire cuts disconnects the removable circuit branch 120, and the other internal wire cut removes/electrically isolates the circuit break load 142, which causes the switching element 132 to switch modes. Typically, additional wires within the LED drive circuit are also cut to allow removal of the removable circuit branch 120. In alternative embodiments, the wires may be cut separately using two or more cuts. Any device or tool may be used to cut the wires, including knives, saws, scissors, lasers, etc. Alternatively, the removable circuit 130 may be removed by snapping, flexing, bending or other similar motion, and or by unplugging the removable circuit 130.

In another embodiment, the removable circuit 130 may be electrically disconnected without cutting wires. In this embodiment, a bias point of the switching element 132 can be set using digital electronics, an op amp/comparator, or any other device to electrically disconnect the removable circuit branch 120 and grounding the retained circuit branch 110.

The switching element 132 can be any device whose state can be switched by varying one or more of its input load(s) or impedence(s). For example, the switching element 132 can include, but is not limited to, a Field Effect Transistor ("FET"), Bipolar Junction Transistor ("BJT"), zener diode, SCR, switch, or relay. Different types of each device can be used. For example, a BJT can be either a pnp or npn. Additionally, although only one device is typically necessary, the switching element 132 can comprise more than one device.

FIG. 1 shows one embodiment in which a single circuit break 170 removes and/or electrically isolates the removable circuit 130 from the circuit by cutting through the circuit branch connector 134, circuit break region 140, and ground break region 142. The specific location/region of the cut is shown for illustrative purposes only; the circuit can be cut anywhere along a circuit branch break region 144, circuit break region 140 and ground break region 142 to remove or electrically isolate the removable circuit 130 from the rest of the circuit.

The circuit branch break region 144 is preferably arranged between the switching element 132 and the removable circuit branch 120. However, in another embodiment the circuit branch break region 144 can include the entire region between connection 135 and a ground point 180. In such an embodiment, the branch break region 144 can include a portion of the circuit branch connector 134, all of the removable circuit branch 120, and the circuit branch ground connector 138.

Similarly, the circuit break region 140 can be anywhere along the switch load connector 160. For illustrative purposes, FIG. 1 shows an embodiment where the disconnection is made only along a portion of the switch load connector 160 that is between the switching element 132 and the circuit break load 142. FIG. 1 also shows only one orientation for the switching element 132, which is also shown to have an exaggerated width to emphasize its spatial relationship to circuit break region 140. Preferably, the switching element 132 is arranged and/or oriented such that its extension in the direction of the circuit break load 142 is minimized (i.e. so that it does not extend far beyond the second switching element connector 150) or even eliminated, thereby maximizing the length of circuit break region 140. The switching element 132 is electrically connected between the retained circuit branch 110 and the removable circuit branch 120 by a first switching element connector 148. The switching element 132 is also electrically connected to ground via a second switching element connector 150, and to the circuit break load 142 via the switch load connector 160.

Figure 2:
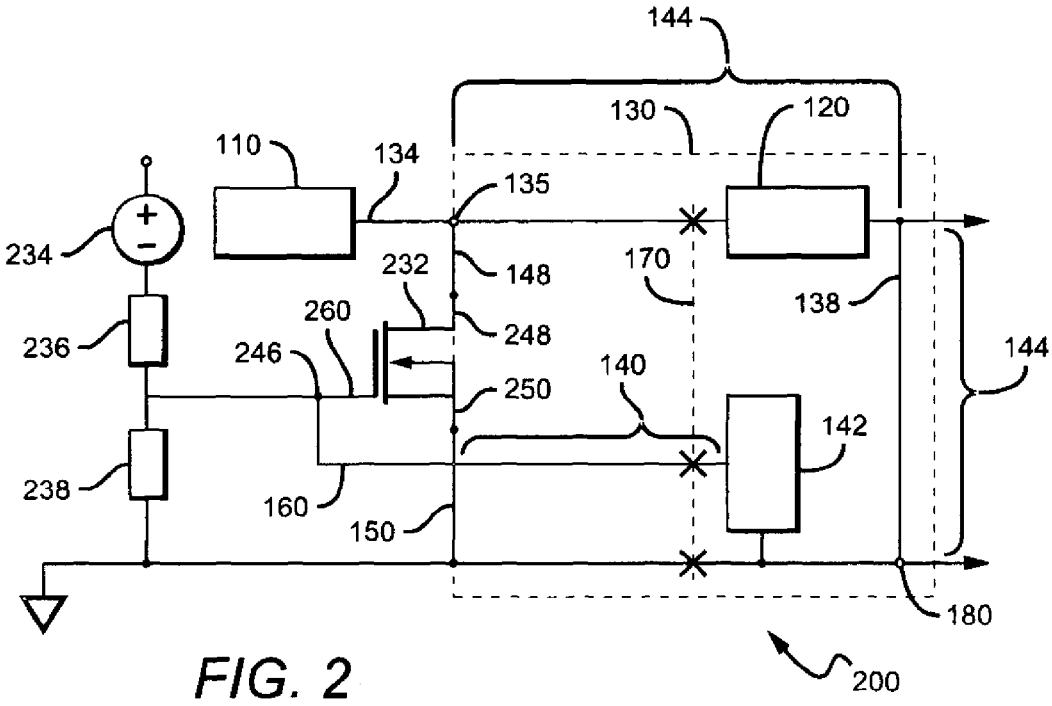
FIG. 2 is a schematic of an embodiment of the drive circuit that uses a switching transistor.

FIG. 2 shows another embodiment in circuit 200, which is similar to that of FIG. 1 in which a switching transistor 232 is used as the switching element 132 and the circuit break load 142 is an element having resistive properties, such as a resistor. Alternatively, the break load can be zero resistance or a shunt. Other elements having resistive properties may also be used for the circuit break load 142. The switching transistor 232 can be any type of transistor switchable between open and closed circuit modes (i.e. operating as a switch), although a Field Effect Transistor (FET) is preferred. The switching transistor 232 shown in FIG. 2 for illustrative purposes has a gate 260 that connects to switch load connector 160, a source 248 that connects to the first switching element connector 148, and a drain 250 that connects to the second switching element connector 150. The gate 260 also preferably connects to first and second gate loads 236 and 238, respectively. The switching transistor 232 is preferably powered by a switching transistor power source 234, which is typically a voltage source, although other types of power sources may also be used. The gate 260 is also connected to the circuit break load 142. Together, the first and second gate loads 236 and 238 and the circuit break load 142 provide a resistive load sufficient to maintain the switching transistor 232 in open circuit mode. Disconnection of the circuit break load 142 from the circuit (by cutting, electrical isolation, or other means as described herein) reduces the resistive load to the gate 260 of the switching transistor 232 enough to cause the transistor to conduct electricity through the connection 135, the first switching element connector 148, the source 248, drain 250, second switching element connector 150 and to ground. The resistive value of the gate loads 236 and 238 and circuit break load 142 can vary. Preferably, the circuit break load 142 has a resistive value such that its disconnection triggers the transistor to switch modes due to a change in current at its gate.

Figure 3:
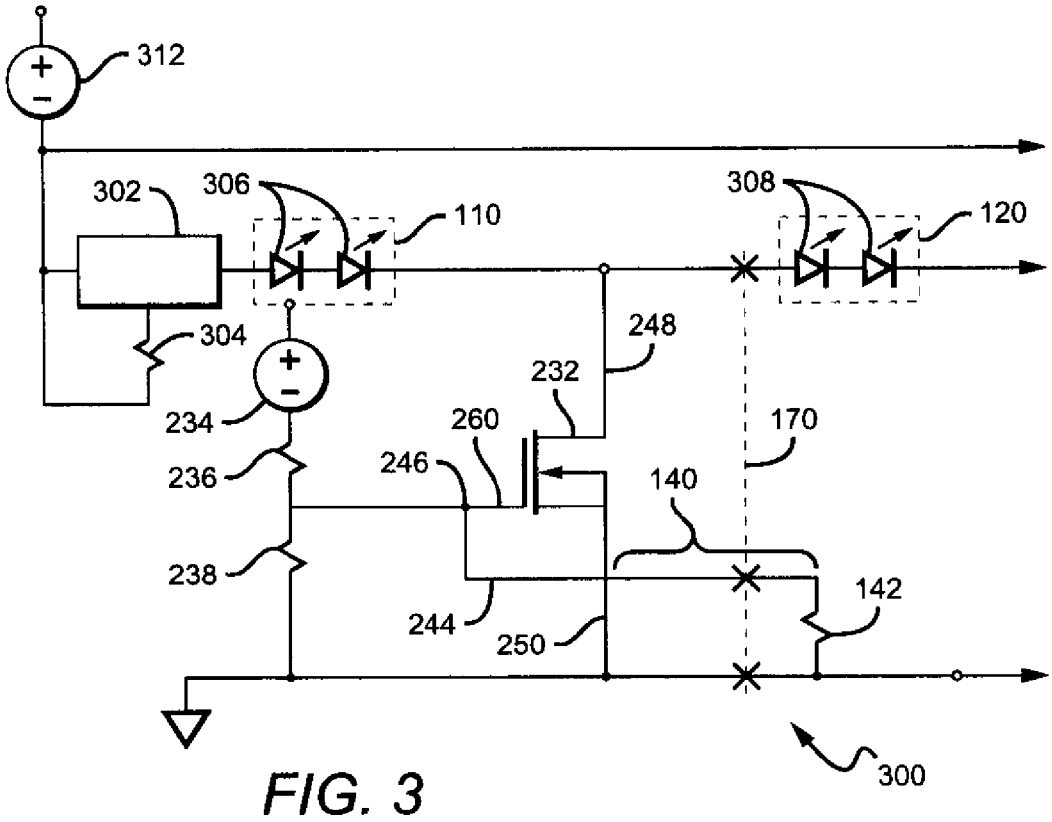
FIG. 3 is a schematic of an embodiment of the drive circuit that has diodes in its retained and removable circuit branches.

FIG. 3 shows another embodiment in circuit 300, which includes many of the same elements described in the other embodiments discussed. The arrangement and interaction of those elements in this embodiment is similar to the previous embodiments. In this embodiment, the first and removable circuit branches 110 and 120 comprise a set of LEDs 306 and 308, respectively, arranged in series. Although two LEDs are shown, more or fewer LEDs may be used. The LEDs 306 and 308 may be connected to a constant current source 302 having a current source resistor 304. A variety of current sources may be used, including the BCR420U manufactured by Infineon. The first gate load 236, second gate load 238 and circuit break load 142 comprise resistors which in one embodiment, have resistances of 24K ohms, 15K ohms and the circuit 100 ohms, respectively, for example. The resistance of these elements is not limited to those values, however. The switching transistor 132 can be any type of FET, including a Metal Oxide Semiconducting FET (MOSFET) such as IRLML2803 made by International Rectifier, or alternatively any other MOSFET. Other transistors capable of switching may also be used, including, but not limited to, Bipolar Junction Transistors ("BJT"), Silicon Controlled Rectifier ("SCR"), relays, zener diodes, and switches.

Figure 4:
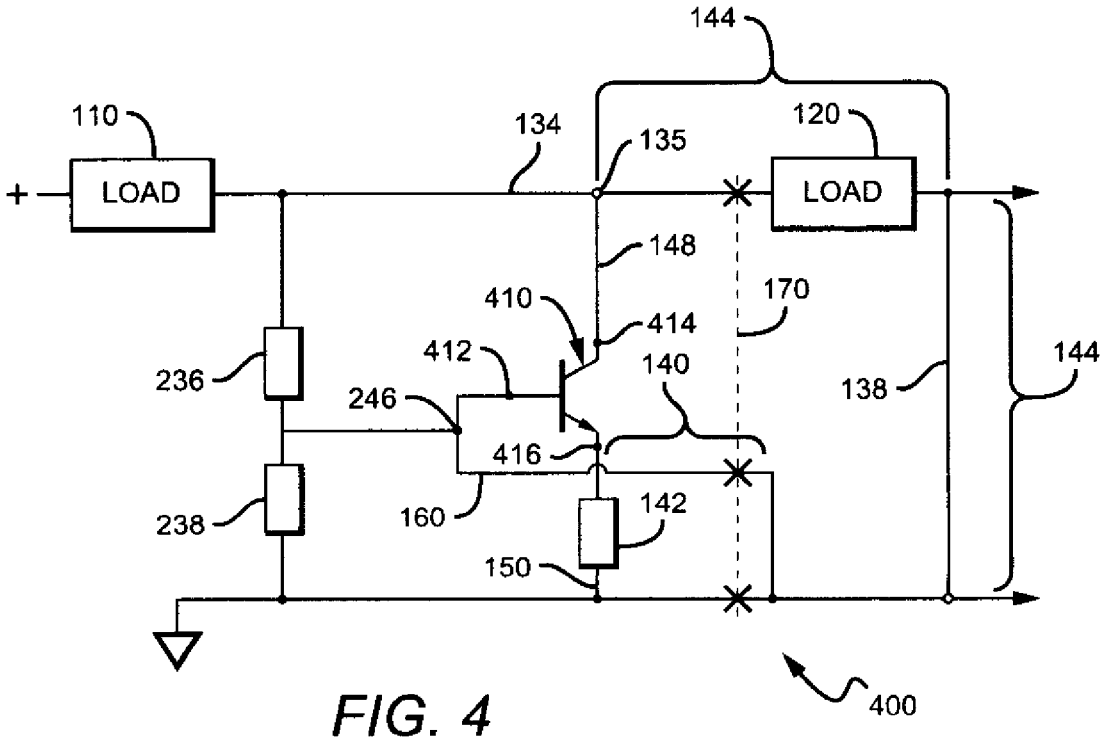
FIG. 4 is a schematic of an embodiment of the drive circuit that uses a Bipolar Junction Transistor.

FIG. 4 shows another embodiment in circuit 400, comprising elements similar to those discussed previously, but having a BJT 410 as the switching element. FIG. 4 illustrates one potential arrangement of the BJT 410, which includes a base 412, a collector 414 and an emitter 416. The base 412 is connected to the switch load connector 160, the collector 414 to the first switching element connector 148, and the emitter 416 to the second switching element connector 150. As discussed with regard to the switching element in the prior embodiments, the BJT 410 is arranged such that it comprises an open circuit until the circuit break load 142 is disconnected or removed as described in the previous embodiments, whereupon the BJT 410 comprises a closed circuit to allow current flow through the retained circuit branch 110.

Figure 5:
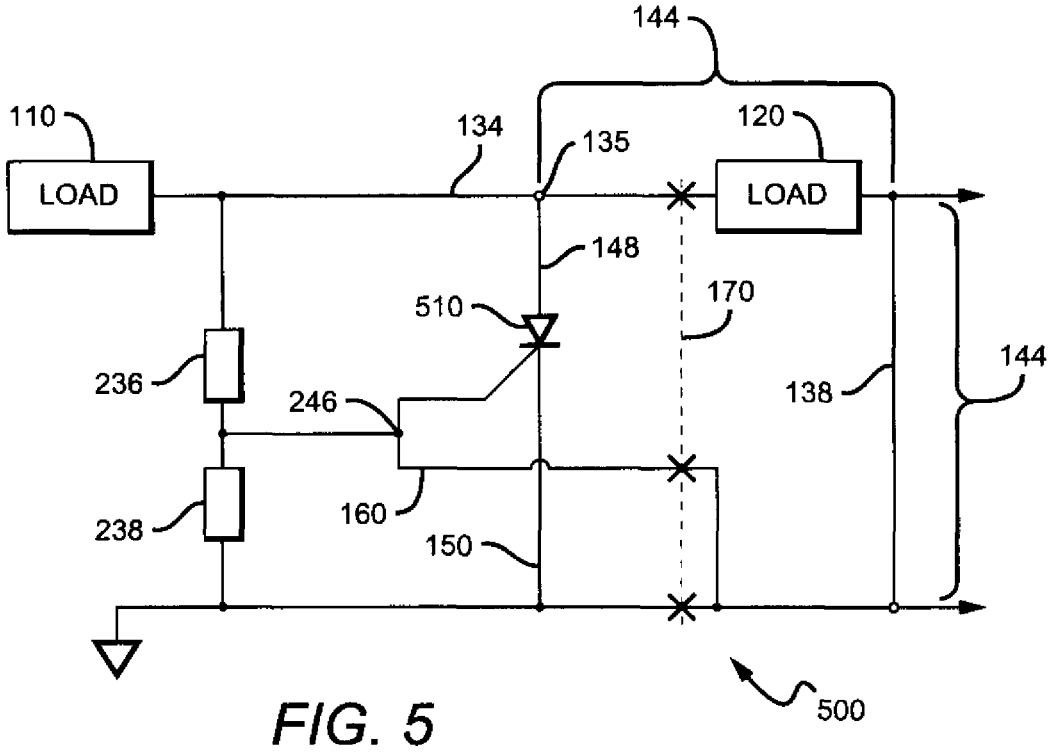
FIG. 5 is a schematic of an embodiment of the drive circuit that uses a Silicon-Controlled Rectifier.

FIG. 5 shows another embodiment in circuit 500, comprising elements similar to those discussed previously, but having a SCR 510 as the switching element. FIG. 5 illustrates one potential arrangement of the SCR 410. SCR 410 is connected as shown in FIG. 5 to the switch load connector 160, the first switching element connector 148, and the second switching element connector 150. As discussed with regard to the switching element in the prior embodiments, the SCR 510 is arranged such that it comprises an open circuit until the circuit break load 142 is disconnected or removed as described in the previous embodiments, whereupon the SCR 510 comprises a closed circuit to allow current flow through the retained circuit branch 110.

Figure 6:
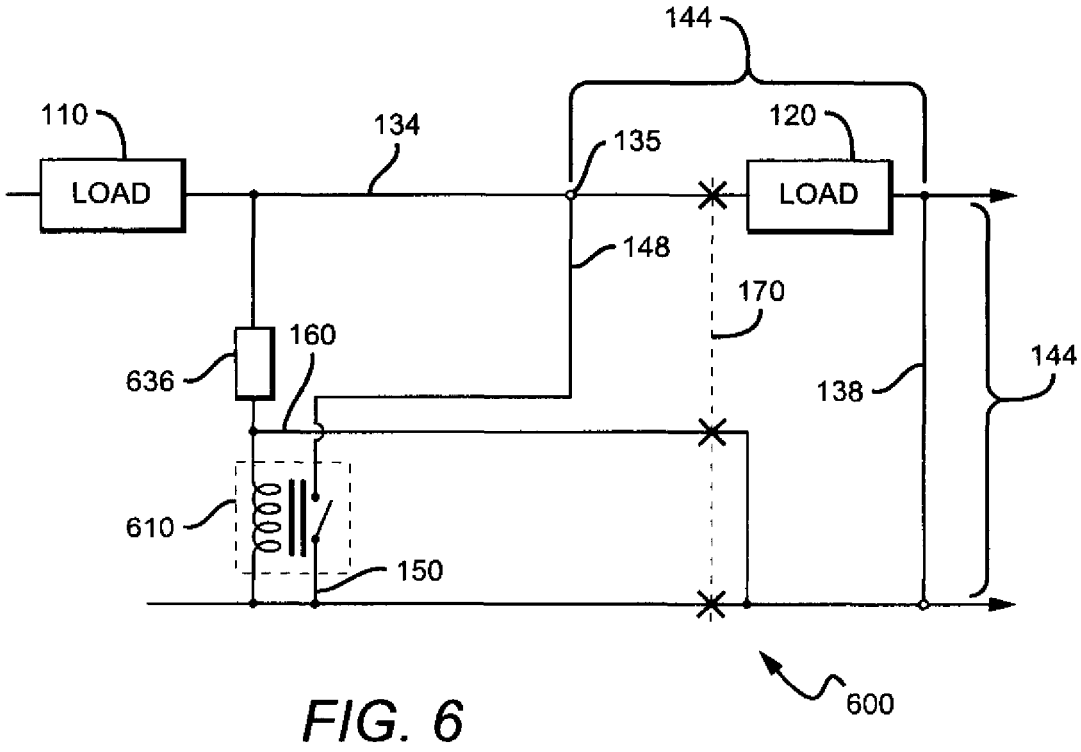
FIG. 6 is a schematic of an embodiment of the drive circuit that uses a Relay Switch.

FIG. 6 shows another embodiment in circuit 600, comprising elements similar to those discussed previously, but having a relay 610 as the switching element. FIG. 6 illustrates one potential arrangement of the relay 610. Relay 610 is connected as shown in FIG. 6 to the switch load connector 160, the first switching element connector 148, and the second switching element connector 150, and includes a relay resistive element 636. As discussed with regard to the switching element in the prior embodiments, the relay 610 is arranged such that it comprises an open circuit until the circuit break load 142 is disconnected or removed as described in the previous embodiments, whereupon the relay 610 comprises a closed circuit to allow current flow through the retained circuit branch 110.

Figure 7:
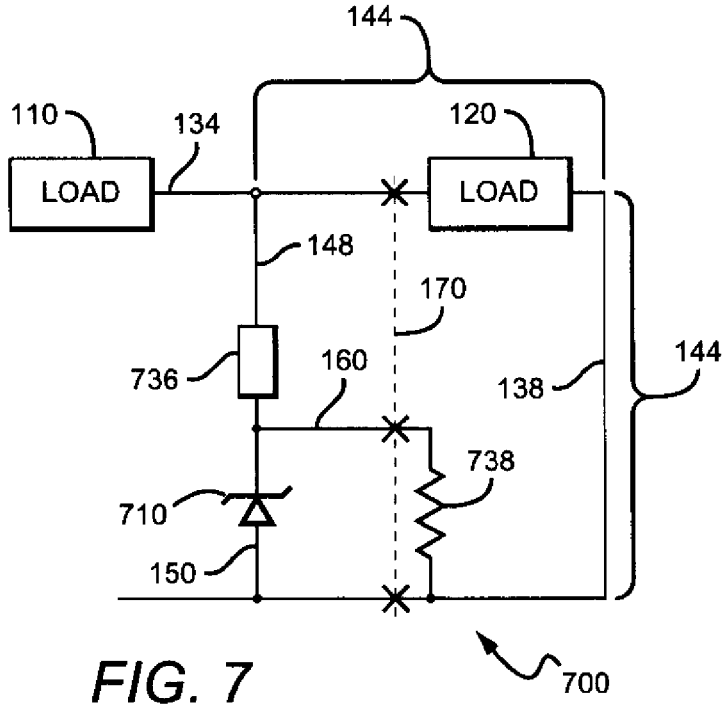
FIG. 7 is a schematic of an embodiment of the drive circuit that uses a Zener Diode.

FIG. 7 shows another embodiment in circuit 700, comprising elements similar to those discussed previously, but having a zener diode 710 as the switching element. FIG. 7 illustrates one potential arrangement of the zener diode 710. Zener diode 710 is connected as shown in FIG. 7 to the switch load connector 160, the first switching element connector 148, and the second switching element connector 150, and includes a zener resistive element 736. As discussed with regard to the switching element in the prior embodiments, the zener diode 710 is arranged such that it comprises an open circuit until the circuit break load 142 is disconnected or removed as described in the previous embodiments, whereupon the zener diode 710 comprises a closed circuit to allow current flow through the retained circuit branch 110.

Figure 8:
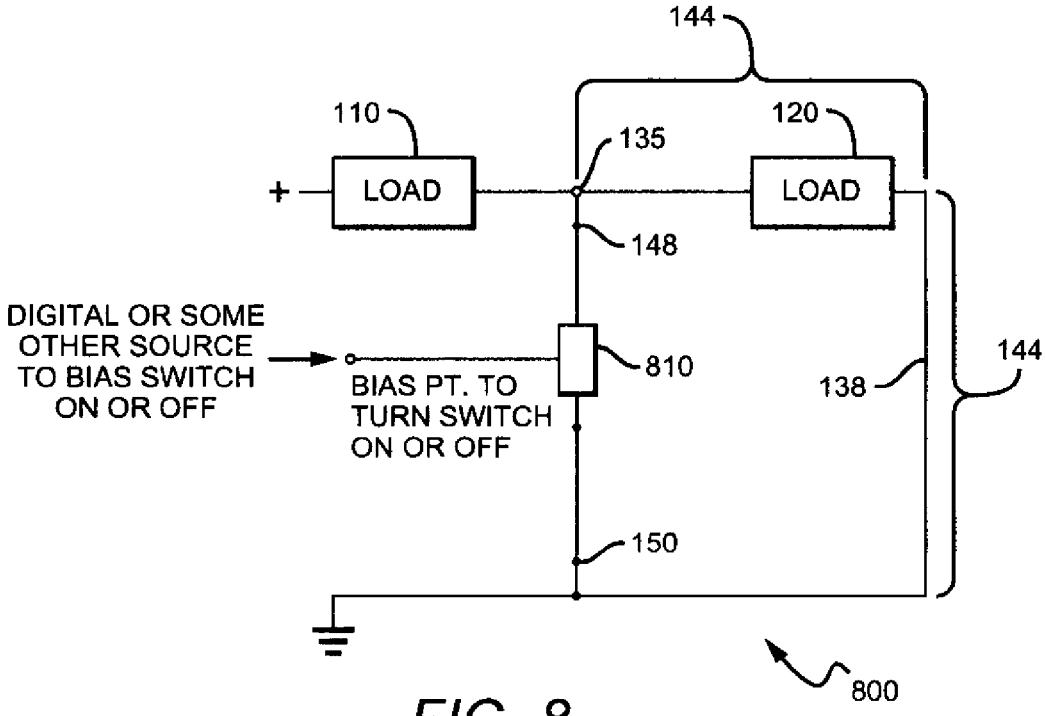
FIG. 8 is a schematic of an embodiment of the drive circuit that uses a Switch.

FIG. 8 shows another embodiment in circuit 800, comprising elements similar to those discussed previously, but having a switch 810 as the switching element. FIG. 8 illustrates one potential arrangement of the switch 810. The switch 810 is connected as shown in FIG. 8 to the first switching element connector 148 and the second switching element connector 150. As discussed with regard to the switching element in the prior embodiments, the switch 810 is arranged such that it comprises an open circuit until it is switched by a biasing digital or analog source, whereupon the switch 810 comprises a closed circuit to allow current flow through the retained circuit branch 110.

Figure 9:
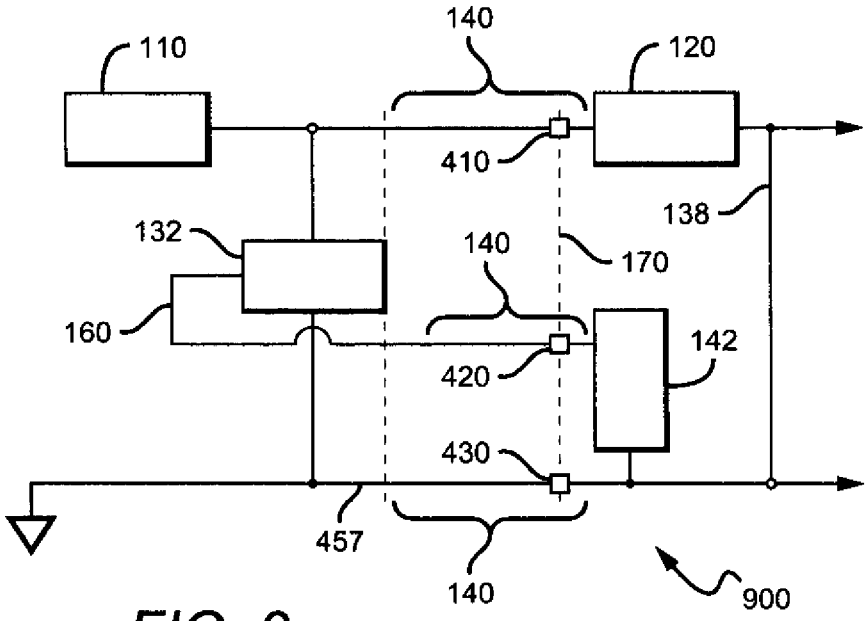
FIG. 9 is a schematic of an embodiment of the drive circuit having connections for removing and attaching a removable circuit.

FIG. 9 shows another embodiment in circuit 900, having elements similar to those discussed previously, but having first, second and third connectors 410, 420 and 430 which allow the removable circuit 130 to be unplugged or detached from the LED drive circuit without cutting at the removable circuit branch 120, the circuit break load 142 and the ground wire 457. The location of the first, second and third connectors 410, 420 and 430 is preferably within the circuit break region 140, which as described in other embodiments is preferably maximized by limiting the extension of the switching element 132 in the direction of the circuit break load 142. Unplugging has the same effect on the circuit as cutting; the switching transistor 132 automatically changes from open to closed circuit mode, thereby grounding the retained circuit branch 110 so it can operate without rewiring. In another embodiment, the removable circuit 130 can also be reattached or re-connected by plugging/re-connecting the removable circuit branch 120, circuit break load 142 and ground wire 457 back into the first, second and third connectors 410, 420 and 430, respectively. Upon reattachment, the switching element 132 automatically changes from closed circuit mode to open circuit mode due to the reintroduction of the circuit break load 142, and the retained circuit branch 110, removable circuit branch 120 and circuit branch ground connector 138 form a closed circuit, providing power to the removable circuit branch 120.

Figure 10:
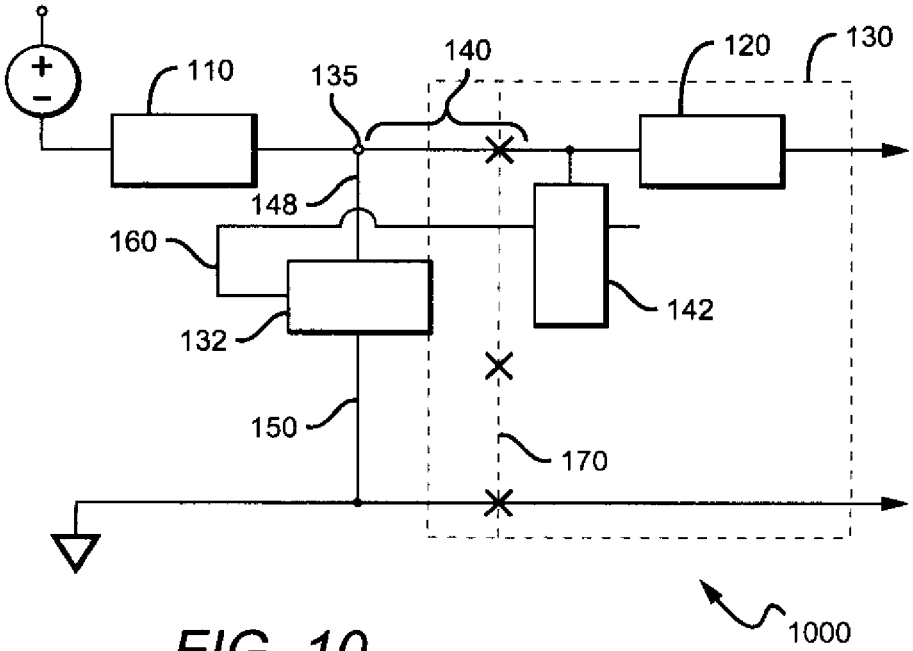
FIG. 10 is a schematic of one embodiment of the drive circuit having a circuit break load connected to the power supply rather than ground circuit branch.

FIG. 10 shows another embodiment in circuit 1000, in which the circuit break load 142 is connected to the power source circuit rather than ground. This embodiment operates similarly to the previous embodiments in which the circuit break load 132 is connected to ground. The switching element 132 is open until disconnection of the circuit break load 142, whereupon the switching element closes to form a closed circuit with the retained circuit branch 110. The switching element 132 is connected between the retained and removable circuit branches 110 and 120, respectively, by the first switching element connector 148 and to ground by the second switching element connector 150 and to the circuit break load 142 by switch load connector 106. The switching element 132 can be any of the devices discussed with respect to the other embodiments, and the disconnection can be achieved as discussed with respect to the other embodiments. For example, the switching element 132 can include, but is not limited to, a FET, zener diode, SCR, switch, relay switch or BJT arranged and configured to operate as described. Where the switching element 132 is a BJT in this embodiment, it is preferably a pnp BJT.

Figure 11:
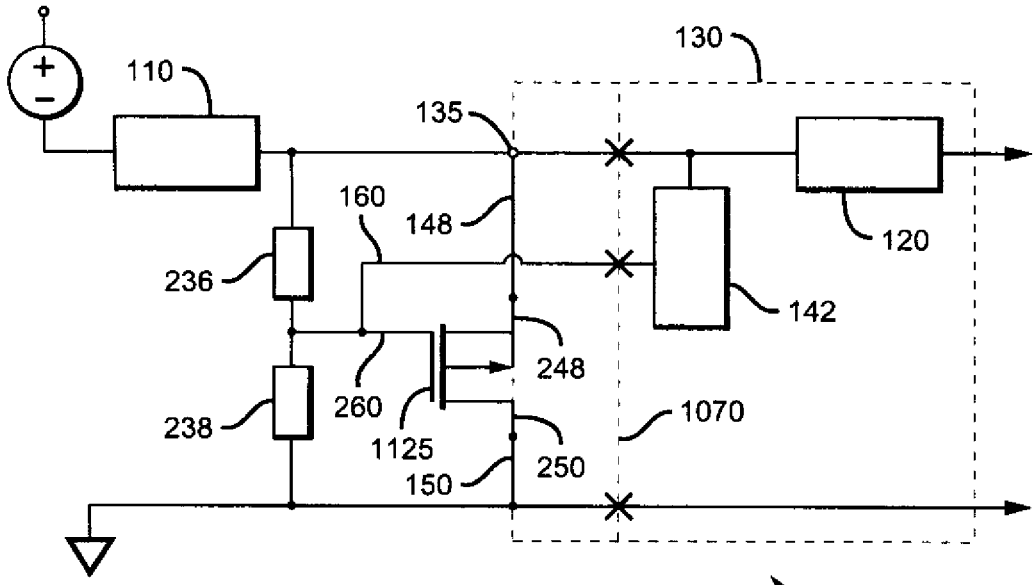
FIG. 11 is a schematic of one embodiment of the drive circuit that uses a p-channel MOSFET.

FIG. 11 shows another embodiment in circuit 1100, comprising elements similar to those in FIG. 2, but having a p-channel MOSFET 1125 as the switching element and the circuit break load 142 connected to source. FIG. 11 illustrates one potential arrangement of the p-channel MOSFET 1125. P-channel MOSFET 1125 is connected as shown in FIG. 11 to the switch load connector 160, the first switching element connector 148, and the second switching element connector 150. As discussed with respect to the embodiment shown in FIG. 2, the p-channel MOSFET 1125 is arranged and configured such that it comprises an open circuit until the circuit break load 142 is disconnected or removed as described in the previous embodiments, whereupon the p-channel MOSFET 1125 comprises a closed circuit to allow current flow through the retained circuit branch 110. The first and second loads 236 and 238 and the circuit break load 142 provide a resistive load sufficient to maintain the p-channel MOSFET 1125 in open circuit mode. Disconnection of the circuit break load 142 from the circuit (by cutting, electrical isolation, or other means as described herein) reduces the resistive load to the gate 260 of the p-channel MOSFET 1125 enough to cause the transistor to conduct electricity through the connection 135, the first switching element connector 148, the source 248, drain 250, second switching element connector 150 and to ground. The resistive value of the loads 236 and 238 and circuit break load 142 can vary. Preferably, the circuit break load 142 has a resistive value such that its disconnection triggers the transistor to switch modes due to a change in current at its gate.

Figure 12:
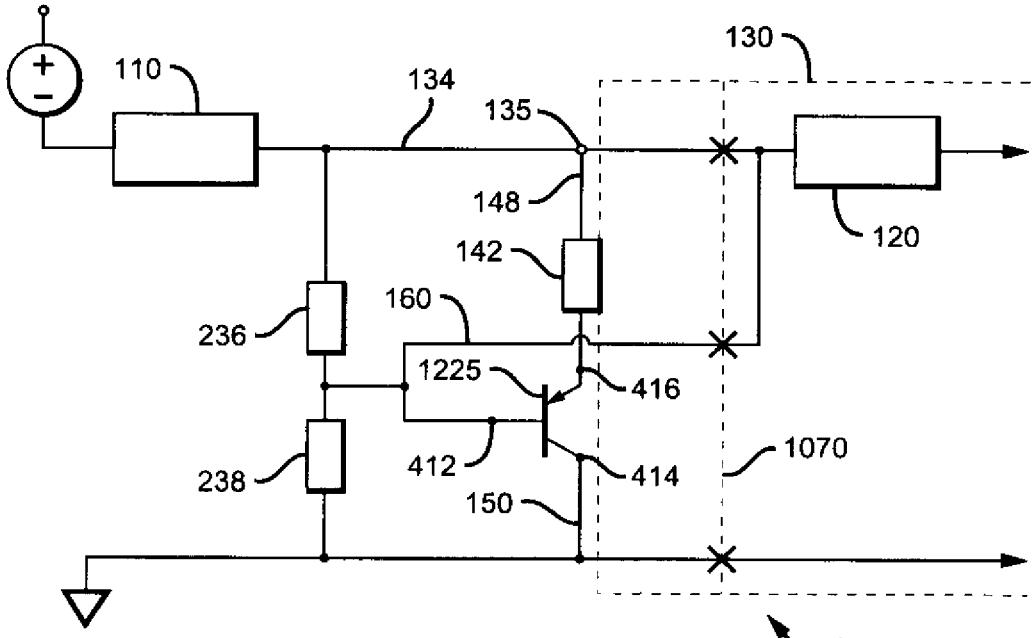
FIG. 12 is a schematic of one embodiment of the drive circuit that uses a PNP BJT.

FIG. 12 shows another embodiment in circuit 1200, comprising elements similar to those in FIG. 4, but having an NPN BJT 1225 as the switching element and with the circuit break load 142 connected to the source instead of ground. FIG. 12 illustrates one potential arrangement of the NPN BJT 1225, which includes a base 412, a collector 414 and an emitter 416. The base 412 is connected to the switch load connector 160, the collector 414 to the second switching element connector 150, and the emitter 416 to the first switching element connector 148. As discussed with respect to the embodiment shown in FIG. 4, the NPN BJT 1225 is arranged such that it comprises an open circuit until the circuit break load 142 is disconnected or removed as described in the previous embodiments, whereupon the NPN BJT 1225 comprises a closed circuit to allow current flow through the retained circuit branch 110.

Figure 13:
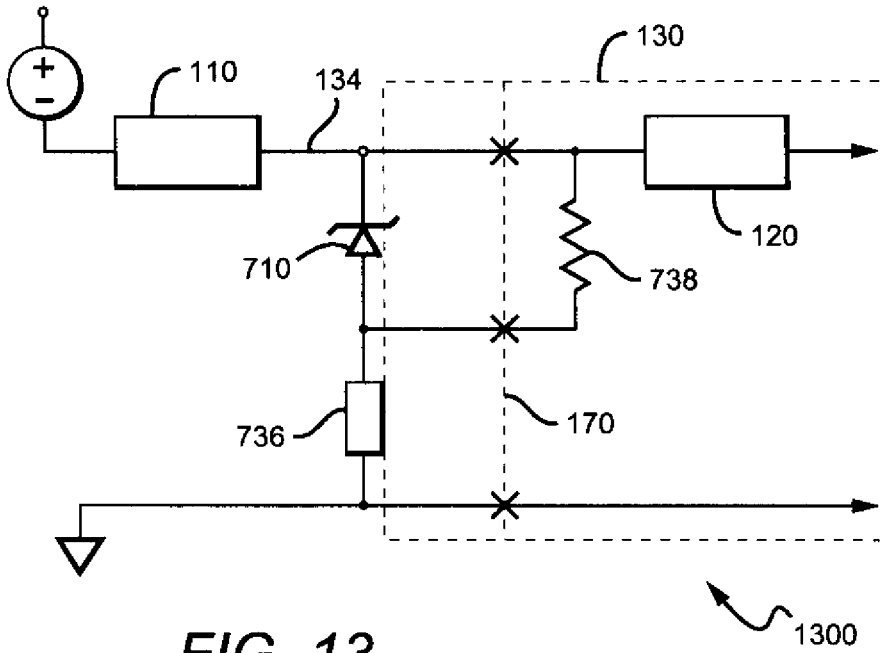
FIG. 13 is a schematic of one embodiment of the drive circuit that uses a zener diode with a positive shunt.

FIG. 13 shows another embodiment in circuit 1300, comprising elements similar to those in FIG. 7, but having a zener diode 710 with a positive shunt. FIG. 13 illustrates one potential arrangement of the zener diode 710. Zener diode 710 is connected as shown in FIG. 13 to the switch load connector 160, the first switching element connector 148, and the second switching element connector 150, and includes a first zener resistive element 736 and a second zener resistive element 738. As discussed with respect to the embodiment shown in FIG. 7, the zener diode 710 is arranged such that it comprises an open circuit until the circuit break load 142 is disconnected or removed as described in the previous embodiments, whereupon the zener diode 710 comprises a closed circuit to allow current flow through the retained circuit branch 110.

Figure 14:
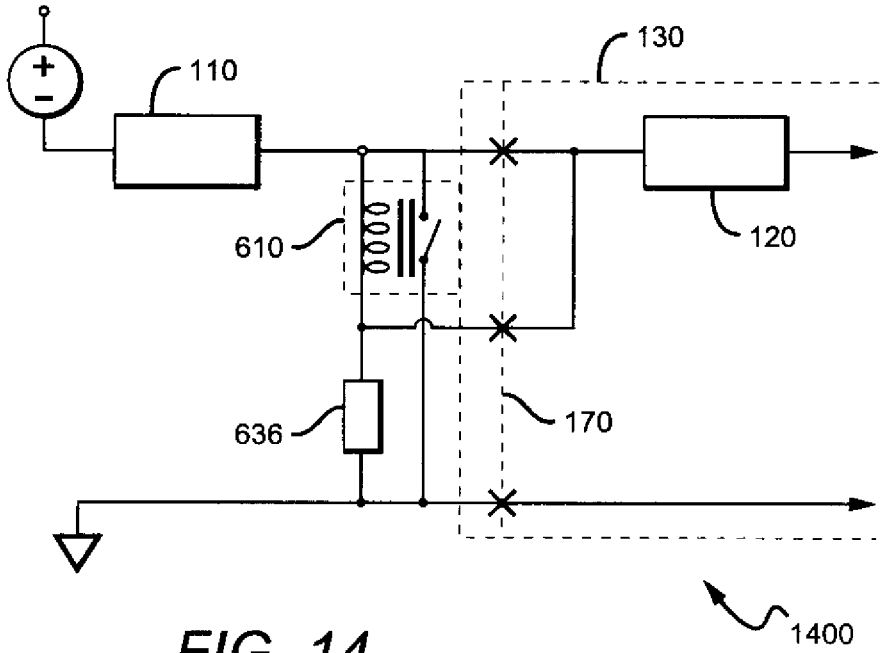
FIG. 14 is a schematic of one embodiment of the drive circuit that uses a relay switch with a positive shunt.

FIG. 14 shows another embodiment in circuit 1400, comprising elements similar to in FIG. 6, but having a relay 610 with a positive shunt. FIG. 14 illustrates one potential arrangement of the relay 610 connected as shown. As discussed with regard to the switching element in the prior embodiments, the relay 610 is arranged such that it comprises an open circuit until the first switching element connector 148 is disconnected or removed as described in the previous embodiments, whereupon the relay 610 comprises a closed circuit to allow current flow through the retained circuit branch 110.

Figure 15:
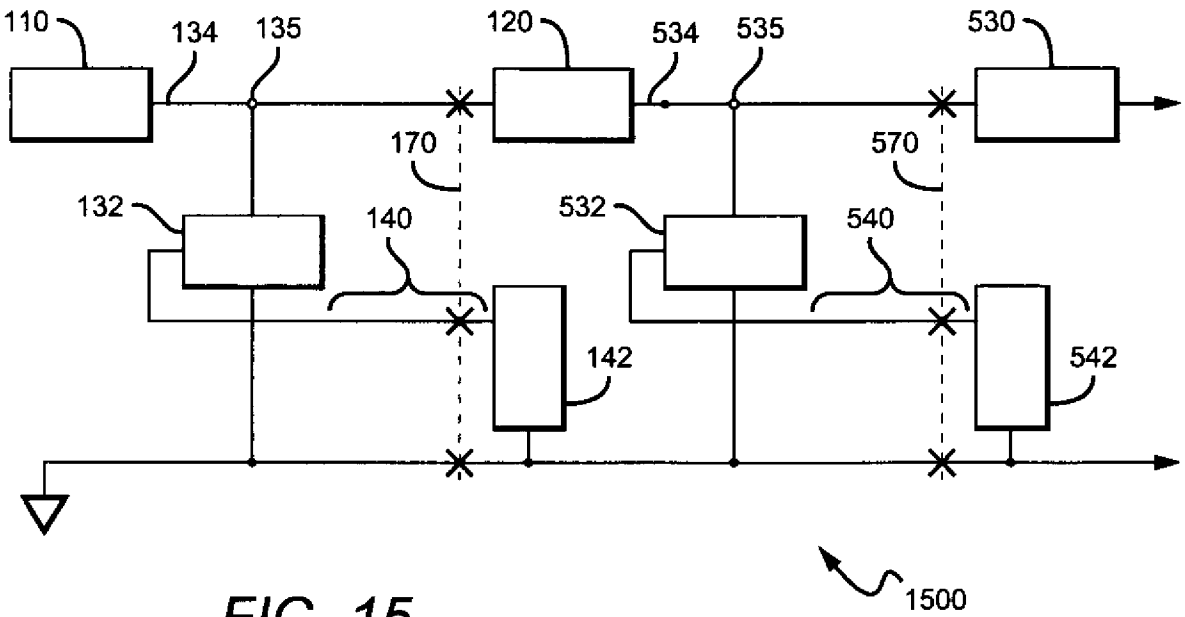
FIG. 15 is a schematic of one embodiment of the drive circuit having multiple branch circuits.

FIG. 15 shows how multiple removable circuit branches interconnect, and can be applied to all embodiments. For illustrative purposes, only one additional branch 530 with its corresponding switching element 532, circuit break region 540 and second circuit break load 542 is shown; any number of circuit branches can be combined together in the manner shown in FIG. 15. The additional branches and their corresponding elements operate as indicated with respect to the prior embodiments, including those where the circuit break load is connected to the source instead of ground.

For all embodiments that involve cutting, any cutting tool such as a knife, laser, etc. may be used. Alternatively, the circuit may be snapped or broken away at a prescribed location. The location can have properties making separation easier such as indentations, etc. Additionally, for all embodiments, the drive circuit housing may be marked to specify where to cut, break or unplug the circuit. The housing can be rigid or flexible, and the LEDs and drive circuits can be packaged in strips or rolls.

For all embodiments, each circuit branch 110 and 120 may have any number and type of circuit elements including, but not limited to resistors, diodes, LEDs, etc. The circuit elements within a particular circuit branch may be connected in series and/or parallel combinations. In the LED drive circuit, other circuit elements such as diodes, etc. may be used to facilitate operation of the circuit. Additionally, the circuit break load in all embodiments can be zero resistance or a shunt.

Although the present invention has been described in considerable detail with reference to certain preferred configurations thereof, other versions are possible. Therefore, the spirit and scope of the invention should not be limited to their preferred versions described above.

What is claimed is:

1. A drive circuit system, comprising:

a retained circuit branch;

a removable circuit branch connected to said retained circuit branch and to an electrical ground, said removable and retained circuit branch forming a closed drive circuit; and a switching element connected between and external to said retained and removable circuit branches and to an electrical ground and to a circuit break load such that said switching element operates as an open circuit, said switching element automatically switching from said open circuit to a closed circuit upon a disconnection of said removable circuit and said circuit break load.

2. The system of claim 1, wherein said switching element comprises a switching transistor.

3. The system of claim 2, wherein said switching element comprises a bipolar junction transistor (BJT).

4. The system of claim 3, wherein said switching element comprises an pnp BJT.

5. The system of claim 3, wherein said switching element comprises an npn BJT.

6. The system of claim 2, wherein said transistor is a field effect transistor (FET).

7. The system of claim 2, wherein said transistor is an n-channel metal oxide semiconducting FET.

8. The system of claim 2, wherein said transistor is a p-channel metal oxide semiconducting FET.

9. The system of claim 1, wherein said switching element comprises a relay.

10. The system of claim 1, wherein said switching element comprises a switch.

11. The system of claim 1, further comprising a circuit break region arranged between said circuit break load and said switching element.

12. The system of claim 11, further comprising a housing for said drive circuit, said housing having one or more markings to indicate said circuit break region.

13. The system of claim 1, wherein said removable circuit branch and said circuit break load have cuttable connections.

14. The system of claim 1, wherein said removable circuit branch and said circuit break load have breakable connections.

15. The system of claim 1, wherein said removable circuit branch and said circuit break load have reattachable connections to allow reattaching of said removable circuit branch and said circuit break load.

16. The system of claim 1, further comprising a switching element power source connected to said switching element for powering said switching element and a circuit branch power source connected to a first circuit of said retained circuit branch for powering said retained circuit branch.

17. The system of claim 1, wherein said retained circuit and removable circuit branches each comprise one or more Light Emitting Diodes (LEDs).

18. The system of claim 1, further comprising a current source connected to said retained circuit branch for powering said retained and removable circuit branches.

19. The system of claim 1, wherein said circuit break load is further connected to an electrical ground.

20. The system of claim 1, wherein said circuit break load is further connected an electrical source.

21. A drive circuit system, comprising:

a retained circuit branch;

a removable circuit branch connected to said retained circuit branch and to an electrical ground, said removable and retained circuit branch forming a closed drive circuit; and a switching element connected between said retained and removable circuit branches and to an electrical ground and to a circuit break load, said switching element automatically switching from an open circuit to a closed circuit upon a disconnection of said removable circuit and said circuit break load, said circuit break load having a circuit break load resistance value capable of reconfiguring said switching element from said open circuit to said closed circuit upon said disconnection.

22. A drive circuit system, comprising:

a retained circuit branch;

a removable circuit branch connected with said retained circuit branch to form a closed circuit; and a switching element connected between and external to said retained circuit branch and said removable circuit and having an open circuit, said switching element automatically having a closed circuit upon a disconnection of said removable circuit.

23. The system of claim 22, wherein said removable circuit comprises a circuit break load connected to said switching element and a removable circuit branch connected to said retained circuit branch.

24. The system of claim 22, wherein said switching element comprises a switching transistor.

25. The system of claim 24, wherein said transistor is a field effect transistor (FET).

26. The system of claim 22, further comprising a circuit break region arranged between said circuit break load and said switching element.

27. The system of claim 26, further comprising a housing for said LED drive circuit, said housing having one or more markings to indicate said circuit break region.

28. The system of claim 22, wherein said removable circuit branch and said circuit break load have cuttable connections.

29. The system of claim 22, wherein said removable circuit branch and said circuit break load have breakable connections.

30. The system of claim 22, wherein said removable circuit branch and said circuit break load have reattachable connections to allow reattaching of said removable circuit branch and said circuit break load.

31. The system of claim 22, further comprising a switching element power source connected to said switching element for powering said switching element and a circuit branch power source connected to a first circuit of said retained circuit branch for powering said retained circuit branch.

32. The system of claim 22, wherein said retained circuit and removable circuit branches each comprise one or more Light Emitting Diodes (LEDs).

33. The system of claim 22, further comprising a current source connected to said retained circuit branch for powering said retained and removable circuit branches.

34. A drive circuit system, comprising:

a retained circuit branch;

a removable circuit branch connected with said retained circuit branch to form a closed circuit; and a switching element connected between said retained circuit branch and said removable circuit and having an open circuit, said switching element automatically having a closed circuit upon a disconnection of said removable circuit, said circuit break load having a circuit break load resistance value capable of reconfiguring said switching element from said open circuit to said closed circuit upon said disconnection.

* * * * *